US005171403A

United States Patent [19]

Chase et al.

[11] Patent Number: 5,171,403

[45] Date of Patent: Dec. 15, 1992

[54] METHOD FOR DETERMINING THE BENDING STIFFNESS OF A MOVING SHEET

[75] Inventors: Lee M. Chase, Los Gatos; John D. Goss, San Jose, both of Calif.

[73] Assignee: Measurex Corporation, Cupertino, Calif.

[21] Appl. No.: 718,199

[22] Filed: Jun. 20, 1991

Related U.S. Application Data

[62] Division of Ser. No. 433,542, Nov. 7, 1989, abandoned.

[51] Int. Cl.[5] ..... D21F 11/00

[52] U.S. Cl. ..... 162/197; 162/198; 162/262; 162/263

[58] Field of Search ..... 162/197, 198, 252, 262, 162/263; 73/159, 862.48, 852

[56] References Cited

U.S. PATENT DOCUMENTS

| | | | |
|---|---|---|---|
| 2,674,127 | 4/1954 | Garrett et al. | 73/159 |
| 2,809,519 | 10/1957 | Kaestner | 73/159 |
| 3,158,021 | 11/1964 | Walters et al. | 73/100 |
| 3,204,454 | 9/1965 | Friman et al. | 73/143 |
| 3,718,037 | 2/1973 | Stringer et al. | 73/144 |
| 4,213,349 | 7/1980 | Miura | 73/852 |
| 4,291,577 | 9/1981 | Baum et al. | 73/597 |
| 4,313,348 | 2/1982 | Madsen | 73/852 |
| 4,587,855 | 5/1986 | Yamada et al. | 73/862.48 |
| 4,674,310 | 6/1987 | Ginzburg | 72/17 |
| 4,864,851 | 9/1989 | Houghton | 73/159 |
| 4,866,984 | 9/1989 | Houghton | 73/159 |
| 5,029,469 | 9/1991 | Chase | 73/159 |

FOREIGN PATENT DOCUMENTS 475609 7/1969 Switzerland .

OTHER PUBLICATIONS

Koran, et al., "The bending stiffness of Paperboard," Tappi Journal, Jun. 1989, pp. 175–179.

*Primary Examiner*—W. Gary Jones
*Assistant Examiner*—Brenda A. Lamb
*Attorney, Agent, or Firm*—Spensley Horn Jubas & Lubitz

[57] ABSTRACT

A method for determining bending stiffness of a moving sheet using an on-line sheet bending stiffness sensor. The sensor continuously bends the sheet as it is being manufactured and, based upon the force required to bend the sheet, the amount of bending and the tension applied to the sheet, the sensor determines a parameter indicative of sheet bending stiffness. The resulting parameter can be correlated with conventional destructive laboratory tests of sheet bending stiffness.

3 Claims, 5 Drawing Sheets

METHOD FOR DETERMINING THE BENDING STIFFNESS OF A MOVING SHEET

This is a division of application Ser. No. 07/433,542, filed on Nov. 7, 1989, now abandoned.

BACKGROUND OF THE INVENTION

The present invention relates to the measurement of the bending stiffness of sheet materials, and more particularly, to the measurement and control of the bending stiffness of paperboard as the board is being manufactured.

Bending stiffness is one of the critical parameters involved in the manufacture of many sheet materials. In the paperboard industry, for example, virtually all paperboard is sold with a bending stiffness specification. Board stiffness is important in the carton-manufacturing process and to the quality of the resulting carton. The proper board stiffness reduces jamming of the board in carton-forming machines by maintaining flat panels as carton blanks are folded. Stiff board also provides the necessary protection of carton contents. Thus, acceptance of a manufacturer's paperboard depends on the manufacturer's ability to meet the desired bending stiffness specifications.

Moreover, paperboard manufacturing is a high speed continuous process. Thus, large amounts of substandard board can easily be produced before subsequent laboratory measurements reveal that the manufactured board is unsuitable for its intended purpose. Consequently, it would be desirable to measure bending stiffness "on-line" as the board is being manufactured in order to avoid wasting time and material.

Several factors make the measurement of paperboard bending stiffness "on-line" difficult. First, the bending stiffness of paperboard varies across the width of the board being produced. Second, the bending stiffness is typically different in the machine direction (i.e., along the direction of sheet movement through the board-forming machine) and the cross direction (i.e., perpendicular to the machine direction). Another barrier to the on-line measurement of bending stiffness is that, during the manufacture of paperboard, the board is pulled through the board-forming machine. Accordingly, any on-line stiffness sensor must be capable of distinguishing the inherent resistance to bending of the board structure from resistance to bending resulting from the tension applied to the board.

In the past, laboratory measurements have been used to determine paperboard stiffness in terms of the results of destructive tests, wherein a relatively small elongated sample is cut from the board and subjected to a bending force. For example, one conventional bending stiffness test is called the "Taber stiffness test". In the Taber stiffness test, a strip of paperboard is clamped at one end, hung from the clamp, and subjected to a bending load at the other end. The Taber stiffness value is the average bending moment necessary to deflect the strip 15 degrees from vertical in the two directions perpendicular to the plane of the strip.

There are numerous other standardized bending stiffness measurements in widespread use throughout the paperboard industry. However, to the best of the present inventors' knowledge, all such measurements require manually testing small samples of the board. Accordingly, such tests are destructive as well as labor and time intensive. Needless to say, therefore, none of these tests lend themselves to use in connection with the continuous on-line measurement of board stiffness. However, because of their widespread popularity, any method used to measure on-line bending stiffness should provide results which correlate with the recognized standard tests.

The basic factors governing the stiffness of paperboard sheet are the sheet thickness and the elastic modulus of the sheet. For a unit width of homogenous sheet, the bending stiffness increases with the cube of the caliper according to the following equation:

$$S = \frac{Et^2}{12}, \tag{1}$$

where,

E=elastic modulus;

t=sheet caliper; and

S=bending stiffness.

Thus, the bending stiffness of paperboard is a product of an intrinsic material property, E, and a geometry factor, $t^3/12$.

The parameters which affect the elastic modulus, E, include the tree species used in the production of the board fiber, the fiber processing and refining techniques, wet pressing, filler content, calendering and the moisture content of the board. In multi-ply sheets, the arrangement of the various plys and the thickness of each ply will also have a significant effect on bending stiffness.

SUMMARY OF THE INVENTION

The present invention includes a device, method and system for non-destructively measuring and controlling the bending stiffness of a sheet material, such as paperboard being manufactured on a paperboard manufacturing machine. This invention will be described with respect to the measurement and control of the bending stiffness of multi-ply paperboard. However, it is to understood that the invention may also be used to measure and control the bending stiffness of single and multi-ply sheet materials whether or not made from paper.

Multi-ply paperboard is ordinarily made in a continuous sheet by high speed machines, often several hundred feet in length. The process of making paperboard frequently involves laying multiple layers of wood pulp fiber onto a rapidly moving porous fabric belt, drying the board and possibly pressing the board between rolls. Other processing steps may also be used in the manufacture of paperboard.

The bending stiffness sensor of the present invention is advantageously used to monitor the bending stiffness of the board after the final processing step, and before the board is cut into pieces for carton-forming operations or other uses. Since the bending stiffness of the board may vary along the length and width of the board, the present invention preferably involves the use of a scanning system whereby the bending stiffness sensor is moved back and forth across the width of the board while the board is being fed toward the cutter. In this way, the bending stiffness profile of the entire paperboard sheet can be determined.

According to the present invention, the bending stiffness sensor includes a sheet support which is disposed adjacent to one side of the board and arranged or constructed to define an open, unsupported area therebetween. For example, a ring may function as such a support. As a portion of the board travels over the open unsupported area on its way to the cutter, it is deflected into this area by a deflecting member. For example, a wheel pressing on the opposite side of the board may be used to deflect a portion of the moving board into the open central area of the previously mentioned ring.

In the deflection distance is fixed by the mechanical arrangement of the sensor components, then the deflecting force applied by the deflecting member is measured. Alternatively, if the deflection force is fixed, for example by a spring or weight attached to the deflecting wheel, then the deflection distance is measured. If neither the deflection force nor distance is predetermined, then both force and distance could be measured. In any event, the tension experienced by the paperboard sheet is also measured and, in combination with the measured deflection distance and/or deflecting force, used to compute a parameter indicative of bending stiffness.

Many modern paperboard mills are highly automated. In such mills, the board-forming process is operated under the supervision of a central process control computer. This process control computer may be coupled to the bending stiffness sensor and a paperboard sheet tension sensor, and programmed to compute the board bending stiffness based upon the deflection force and distance and the sheet tension. When the determined bending stiffness is within the desired specification limits, then the process control computer continues the board-forming operation without modification. However, in the event that the bending stiffness is outside of the desired specification limits, then the computer can be programmed to alter the board-forming process to increase or decrease the bending stiffness of the paperboard sheet, as required. As set forth above, a variety of factors are known to affect sheet stiffness and one or more of these factors may be adjusted, under computer control, to achieve the desired bending stiffness.

DETAILED DESCRIPTION OF THE DRAWINGS

Figure 1:
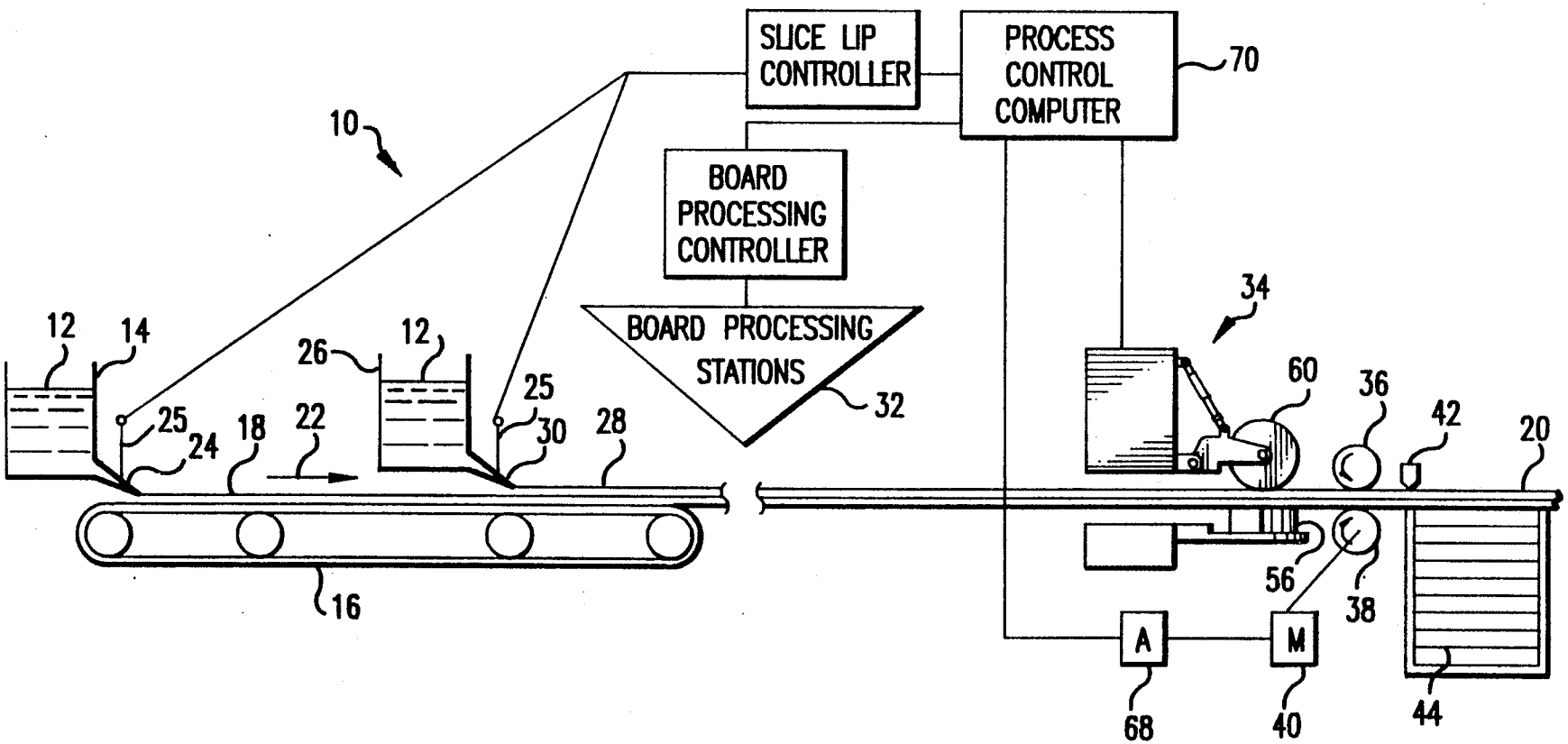
FIG. 1 is a highly simplified schematic illustration of a dual headbox paperboard machine for forming two-ply paperboard sheet, wherein the amounts of fiber deposited on the porous conveyer belt by the headboxes are independently adjustable under control of the process control computer based upon on-line measurements from the bending stiffness sensor and measurements of sheet tension.

FIG. 1 provides, in highly simplified schematic form, an overview of a typical paperboard sheet manufacturing process for a dual headbox paperboard manufacturing machine 10. As illustrated in this figure, a slurry 12 of water and paper pulp fibers flows from a primary headbox 14 onto a moving porous conveyer belt 16, called a "wire", on which the slurry 12 forms the continuous first ply 18 of the paperboard 20 moving in the direction of arrow 22. A "slice lip" 24 regulates the flow of slurry 12 from the primary headbox 14 onto the wire 16. The slice lip 24 is made from a flexible elongated member spanning the width of the board 20 in the cross-direction. The slice lip 24 may be flexed at intervals across the width of the board 20 to thereby control the amount of slurry 12 deposited on the wire 16 at each cross-directional location. Various devices 25 for controlling the thickness of the slice lip opening at plural positions along the cross-direction of the board 20 are well known in the paperboard manufacturing industry. The water component of the slurry 12 drains through the porous wire 16, thereby leaving a single-ply 18 of wet fibers on the wire 16.

The secondary headbox 26 deposits a second layer 28 of slurry 12 on the previously formed first ply 18. As in the case of the first ply 18, the water component of the slurry 12 from the secondary headbox 26 also drains through the wire 16. The amount of fiber contained in the second ply 28 is dependent, at least in part, upon the slice lip opening for the secondary headbox 26. The slice lip 30 for the secondary headbox 26 is also controllable at intervals along the cross-direction of the board 20 to thereby release more or less slurry 12 onto the wire 16.

After the secondary headbox 26 deposits the second ply 28, the wet two-ply paperboard sheet 20 may undergo additional processing, as necessary. For example, the wet two-ply sheet 20 may undergo wet pressing, calendering, additional drying, etc. Such additional processing steps and the devices for conducting these additional processing steps are well known in the paperboard industry. Therefore, the devices for conducting such additional processing steps are represented collectively only in schematic form at reference numeral 32 in FIG. 1.

Following the additional processing steps, the board 20 proceeds through the bending stiffness sensor 34. After measurement by the bending stiffness sensor 34, the board 20 then passes through a pair of pinch rolls 36, 38. These rolls 36, 38 are driven by a motor 40 which assists in pulling the board 20 through the board-forming machine. Downstream (relative to the direction of board travel) of the pinch rolls 36, 38, a blade 42 cuts the board 20 into individual sheets 44 which may be collected in a stack and subsequently transported for further processing.

Figure 2:
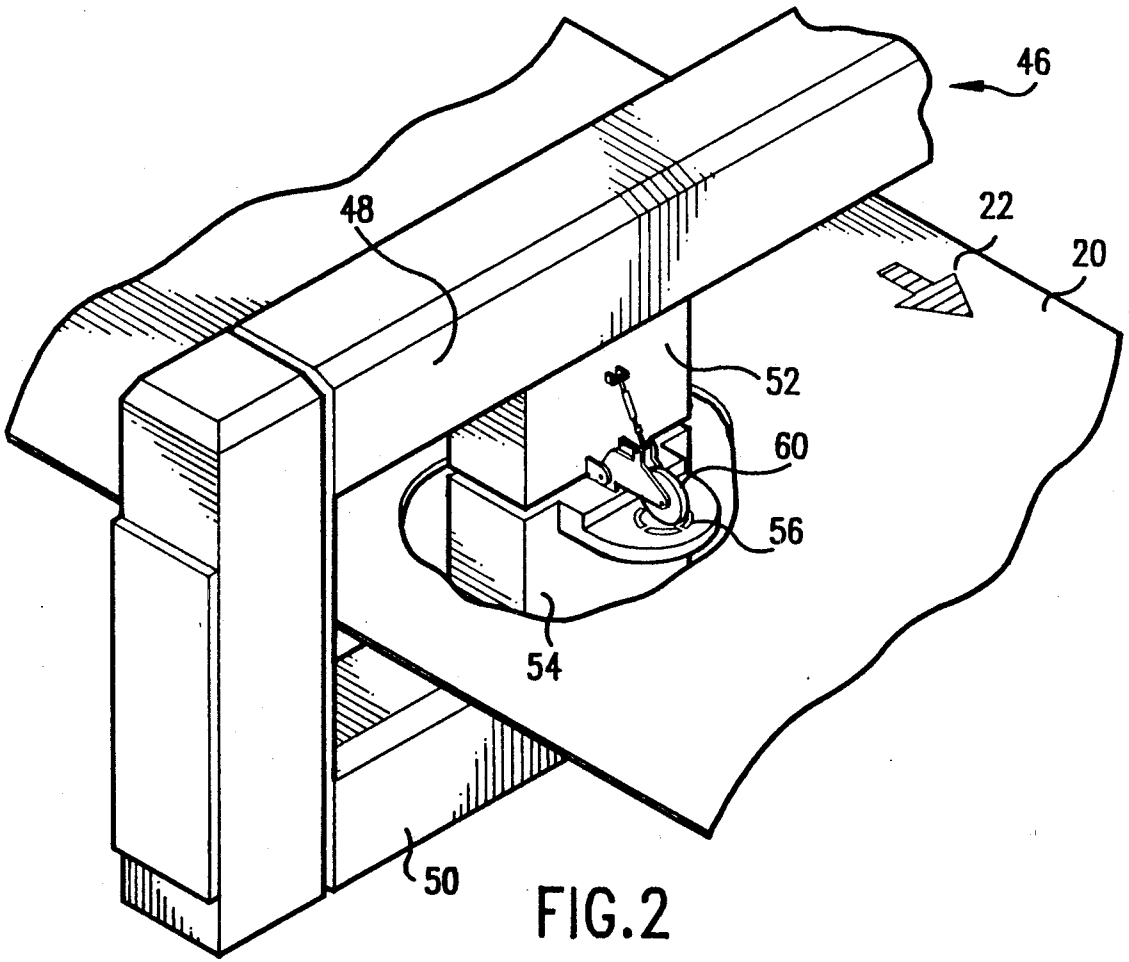
FIG. 2 illustrates a conventional scanner having one embodiment of the bending stiffness sensor mounted thereto for scanning the sensor repeatedly back and forth across the width of the board.

FIG. 2 illustrates a scanner 46 which moves the bending stiffness sensor 34 repeatedly back and forth across the width of the paperboard sheet 20 so that the bending stiffness of the entire board 20 may be measured. As noted above, the bending stiffness sensor 34 and scanner 46 are preferably located after the final processing station 32.

In FIG. 2, the board 20 can be seen passing through the scanner 46 between two transverse beams 48, 50, on which are mounted upper and lower scanning sensor support members 52, 54. The paperboard 20 is shown with a cut-out area so that the relationship between the support members 52, 54 can be seen. A motor (not shown) within the scanner 46 is coupled to and drives the support members 52, 54 back and forth across the width of the board 20, in a continuous scanning motion, while keeping the support members 52, 54 in vertical alignment at all times.

Figure 3:
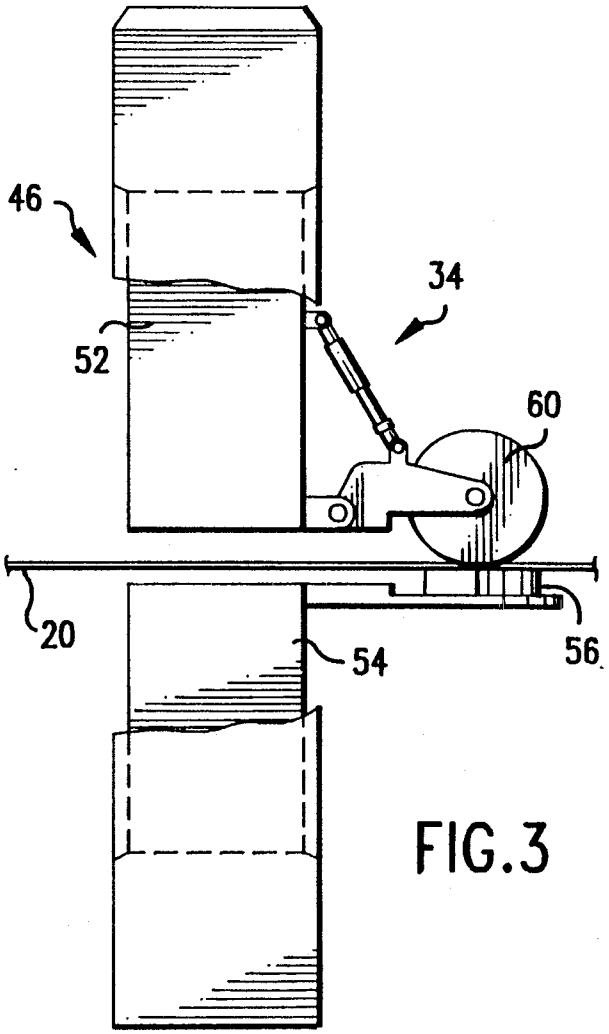
FIG. 3 is a partially cut-away side view of the scanner and bending stiffness sensor illustrated in FIG. 2.

FIG. 3 is a partially broken-away side view of the scanner 46 and sensor 34 of FIG. 2, illustrating in greater detail the relationship and construction of the the top and bottom halves of of the bending stiffness sensor 34.

Figure 4:
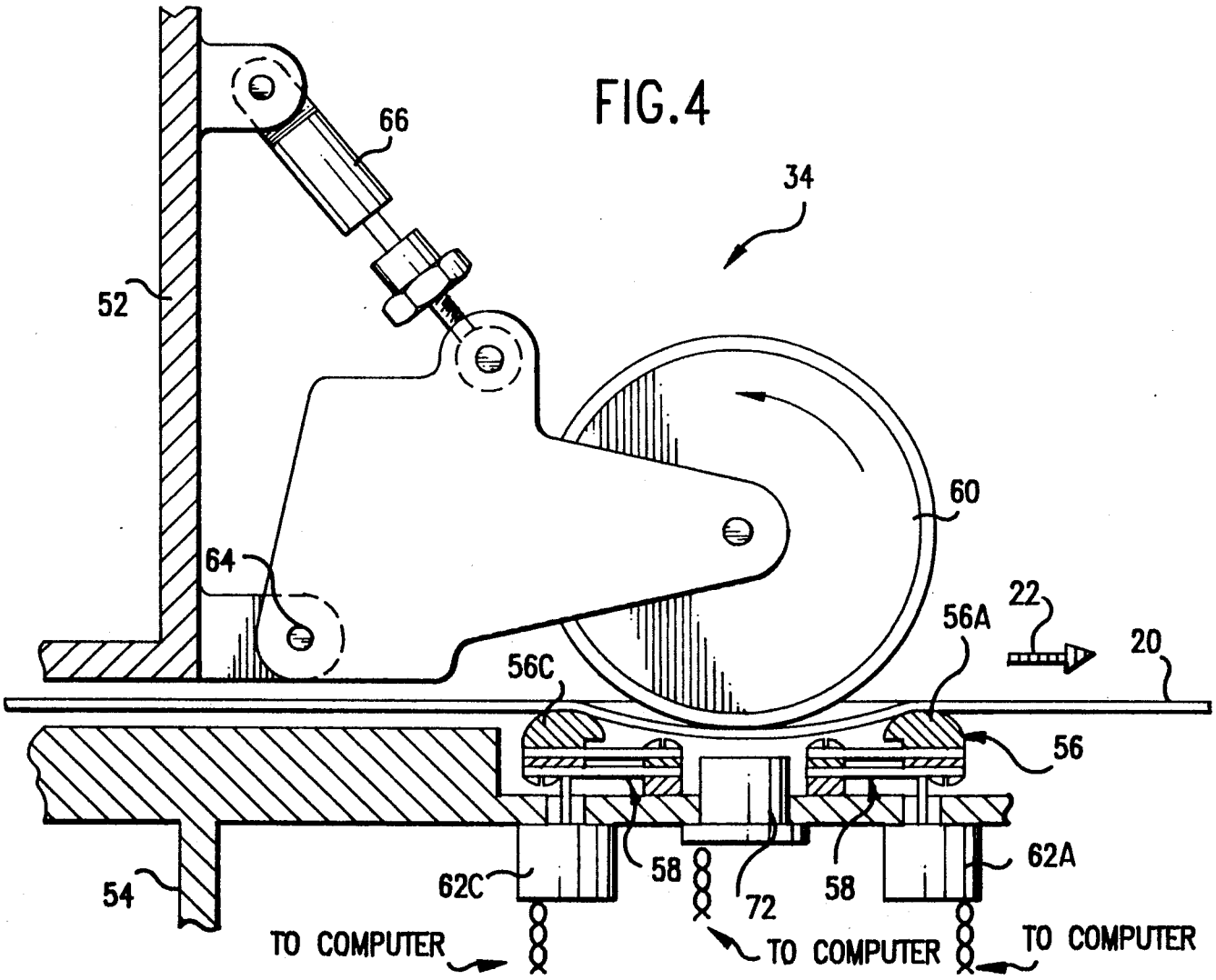
FIG. 4 is a more detailed view of the bending stiffness sensor of FIG. 3, showing the construction details and instrumentation of the board-supporting ring.
Figure 5:
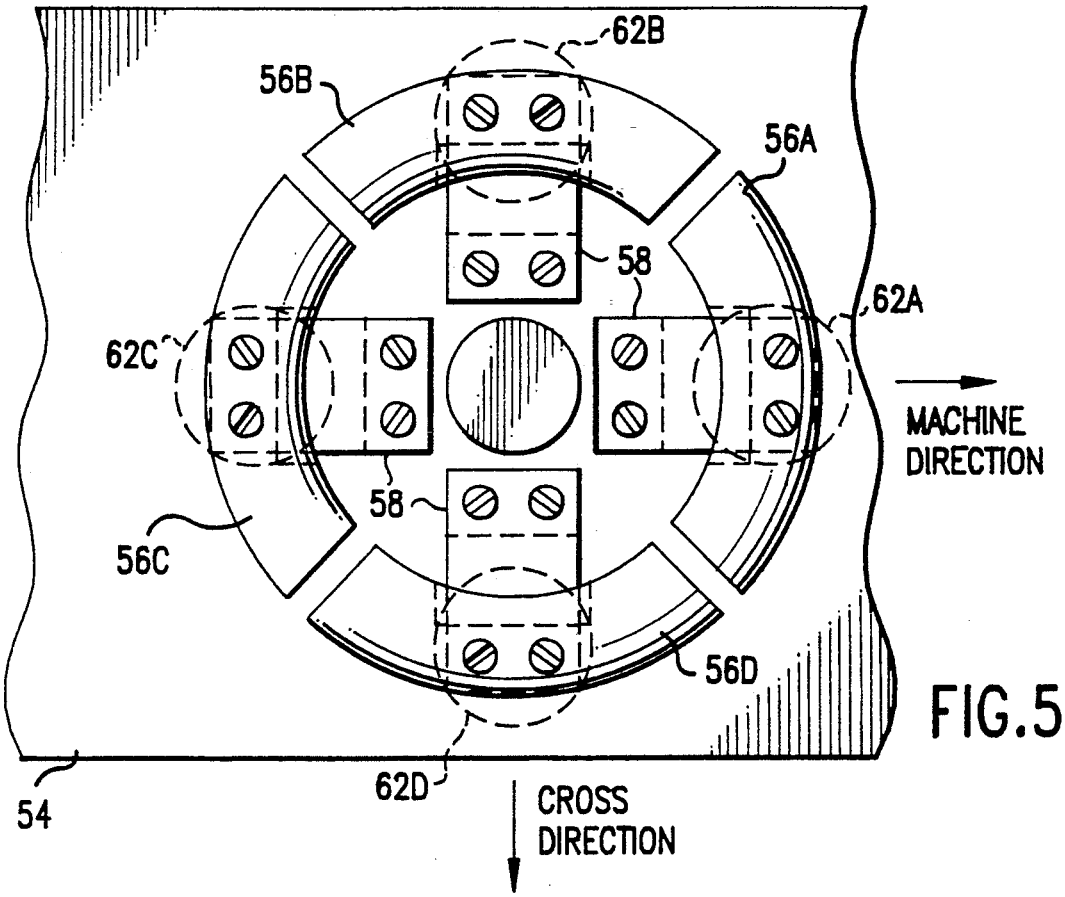
FIG. 5 is a top view of the segmented ring structure of the bending stiffness sensor illustrated in FIG. 4.

FIGS. 4–5 illustrate in still greater detail the construction and arrangement of the bending stiffness sensor 34. The bending stiffness sensor 34 utilizes a sheet support ring 56 which is split into four segments, 56A, 56B, 56C and 56D, each occupying approximately 90 degrees of the ring circle. Each segment, 56A, 56B, 56C and 56D, is supported on a pair of leaf springs 58. The wheel 60 is positioned to forcibly deflect the moving board 20 into the center of the ring 56. It is preferred that the periphery of the wheel 60 be spherically convex rather than cylindrical. For purpose of example, and not by way of limitation, the diameters of the wheel 60 and ring 56 may each be about 5 inches.

A load cell 62A, 62B, 62C and 62D, is associated with each ring segment to sense the downward force of the moving board 20 on the corresponding ring segment. The four ring segments 56A–56D, are aligned so that two segments, 56A and 56C, are disposed on opposite sides of the ring 56 on a line oriented in the machine direction. These "machine direction" ring segments, 56A and 56C, are sensitive to the machine direction characteristics of the paperboard sheet 20. The remaining two ring segments, 56B and 56D, are sensitive to the "cross direction" characteristics of the paperboard sheet 20.

The wheel 60 is pivotally mounted to upper scanning support member 52 by pivot pin 64 and the distance which the wheel 60 deflects the board 20 into the ring 56 depends upon the position of an extendable air cylinder actuator 66. This actuator 66 is operated under computer control such that, for a first position of the actuator 66, the wheel 60 is positioned to deflect the board 20 into the ring 56 by a relatively small distance, for example, 1.5 millimeters below the top surface of the ring 56. At a second, extended position of the air cylinder actuator 66, the wheel 60 is positioned to deflect the board 20 into the ring 56 by a greater distance, for example, 3.5 millimeters below the top surface of the ring 56.

For each wheel position, the wheel 60 forces a portion of the board 20 by a lesser or greater distance into the center of the ring 56. Thus, the portion of the board 20 deflected into the ring 56 must travel a greater distance than the remainder of the board 20 which travels in a straight-line path outside of the ring 56. Since the deflected portion of the board 20 is stretched by the wheel 60 inside the ring 56, the load sensed by each load cell, 62A, 62B, 62C and 62D, is affected by the extensional stiffness of the deflected board portion. The force sensed by each load cell, 62A, 62B, 62C and 62D, also depends upon the tension exerted on the board 20 by the pinch rolls 36, 38, which pull the board 20 through the bending stiffness sensor 34, and the bending stiffness of the deflected board 20.

There are a number of ways to measure the tension applied to the board 20 by the pinch rolls 36, 38. According to one method, the amount of current drawn by the pinch roll motor 40 is used to indicate the load on that motor 40 and hence the average tension across the width of the paperboard sheet 20. Therefore, as illustrated in FIG. 1, an ammeter 68 is operatively coupled to the motor 40. The ammeter 68 generates a signal indicative of the current drawn by the motor 40. This signal is then used by the process control computer 70 to determine the average tension across the width of the paperboard sheet 20.

The amount of deflection experienced by the board 20 as it travels through the bending stiffness sensor 34 may be measured with a displacement or deflection sensor 72 which measures the position of the wheel 60 within the ring 56. The displacement sensor 72 may be any one of a variety of known sensors, such as an eddy current device, using magnetic fields to determine the position of a metallic wheel 60 and hence the amount of board deflection.

As previously mentioned, the force of the board 20 against the sensor ring segments, 56A, 56B, 56C and 56D, measured by the load cells 62A, 62B, 62C and 62D, is the result of three additive factors: (1) the stress in the board caused by the strain due to local distortion by the sensor wheel 60 when it pushes the board 20 into the ring 56, (i.e., the extensional stiffness); (2) the machine-directionally oriented tension applied to the board 20 by the machinery; and (3) the board bending stiffness. The force applied by the board 20 to the machine direction ring segments, 56A and 56C, (as measured by the corresponding machine-direction load cells, 62A and 62C) at each cross-directional position, i, across the width of the board 20, may be stated mathematically as:

$$\text{OUTPUT}_{md}(i) = A_{md}{*}E_{md}(i){*}t(i){*}L(z(i))\ \text{(strain term)} + B_{md}{*}T(i){*}t(i){*}\frac{z(i)}{R}\ \text{(tension term)} + C_{md}{*}b_{md}(i){*}\frac{z(i)}{R}\ \text{(bending term).} \quad (2)$$

Where:

$\text{OUTPUT}_{md}(i)$ = the sum of the force of the paperboard sheet 20 against both of the machine direction ring segments 56A and 56C measured by the machine direction load cells 62A and 62C at each cross-directional position, i, t(i) = the caliper of the paperboard sheet at each cross-directional position, i. t(i) may be measured by a conventional sheet caliper gauge.

$E_{md}(i)$ = Young's modulus of the paperboard sheet in the machine direction at cross-directional position, i, L(z(i)) = a function relating the extensional stiffness of the sheet (i.e., $E_{md}(i){*}t(i)$) to stress in the sheet caused by sheet strain as the sensor wheel 60 pushes the paperboard sheet 20 into the ring 56 a distance z at each cross-directional position, i, z(i) = the vertical distance that the wheel 60 pushes the paperboard sheet 20 into the center of the ring 56 at each cross-directional position, i, T(i) = the paperboard sheet machine direction tension at each cross-directional position, i. (If measured as a function of the current drawn by the pincher roll motor 40, then the value of T(i) is the average tension across the width of the paperboard sheet), R = the radius of the ring 56 measured where the paperboard sheet 20 contacts the ring 56; and $b_{md}(i)$ = the machine directional bending resistance of the paperboard at each cross-directional position, i.

$A_{md}$, $B_{md}$ and $C_{md}$ = proportionality constants.

An equation similar to equation 2 above exists for the cross-directional output of the sensor ring, as follows:

$$\text{OUTPUT}_{cd}(i) = A_{cd}*E_{cd}(i)*t(i)*L(z(i))\ \text{(strain term)} + B_{cd}*T(i)*t(i)*\frac{z(i)}{R}\ \text{(tension term)} + C_{cd}*b_{cd}(i)*\frac{z(i)}{R}\ \text{(bending term)}. \quad (3)$$

Where:

$\text{OUTPUT}_{cd}(i)$ = the sum of the force of the paperboard sheet 20 against both of the cross direction ring segments, 56B and 56D, measured by the cross-directional loads cells, 62B and 62D, at each cross-directional position, i, $E_{cd}(i)$ = Young's modulus of the sheet in the cross direction at cross directional position, i, $b_{cd}(i)$ = the cross directional bending resistance of the paperboard at each cross directional position, i, $A_{cd}$, $B_{cd}$ and $C_{cd}$ = proportionality constants, and the remaining terms are as previously defined.

Evaluation of L(z(i))

Figure 6:
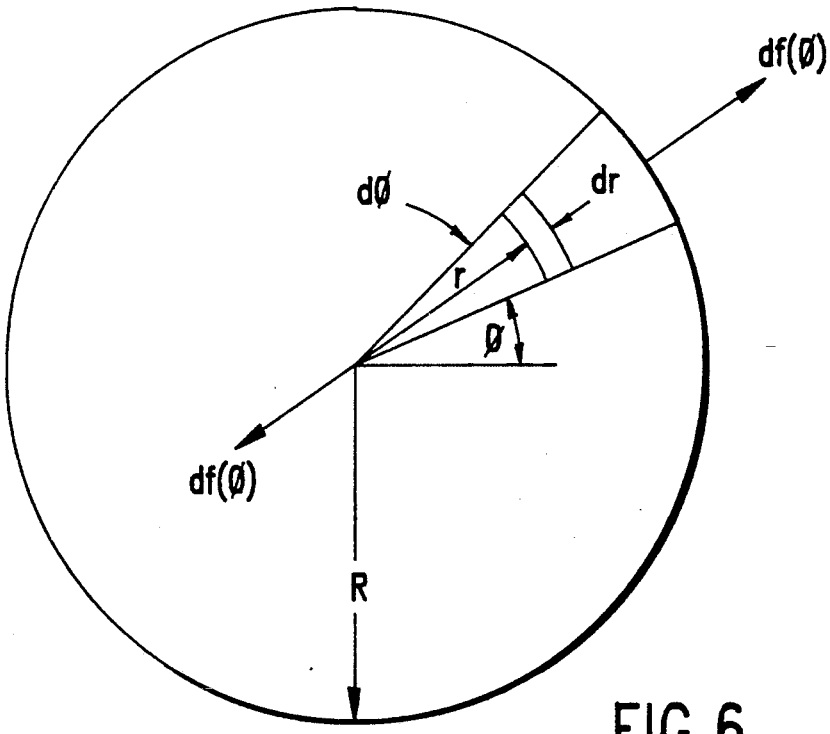
FIG. 6 is a diagramatic illustration of the stress on a portion of the paperboard sheet deflected within the segmented ring of FIG. 5.

FIG. 6 illustrates the circular portion of the paperboard sheet 20 supported within the segmented ring 56. Referring to FIG. 6, consider an infinitesimal wedge of the paperboard sheet 20 of an angle $d\phi$ of radius r. The stress distribution in this wedge, caused by an infinitesimal force $df(\phi)$ applied in the radial direction at the center of the ring and an opposite restraining force applied at radius R, can be determined. The force at any radius, r, along the wedge is related to the stretch or "strain" of the sheet 20 by the equation:

$$df(\phi) = E(\phi)*t*r*d\phi*(ds(r,\phi)/dr) \quad (4)$$

where:

$d\phi$ = the infinitesimal angle of the wedge, dr = an increment of radius r;

$df(\phi)$ = the increment of force applied in the radial direction;

$ds(r,\phi)$ = the strain induced in element dr by force $df(\phi)$;

$\phi$ = an angle, measured in the plane defined by the undeflected sheet, from a line oriented in the machine direction, $E(\phi)$ = Young's modulus of the sheet as a function of $\phi$, t = the thickness of the sheet.

Equation (4) gives the force, $df(\phi)$, required to produce a strain in the sheet, ds, at point r, $\phi$, on the sheet. By rearranging the elements of equation (4), the strain caused by an applied force is then:

$$ds(r,\phi)/dr = (df(\phi)/d(\phi))/(E(\phi)*t*r) \quad (5)$$

Figure 7:
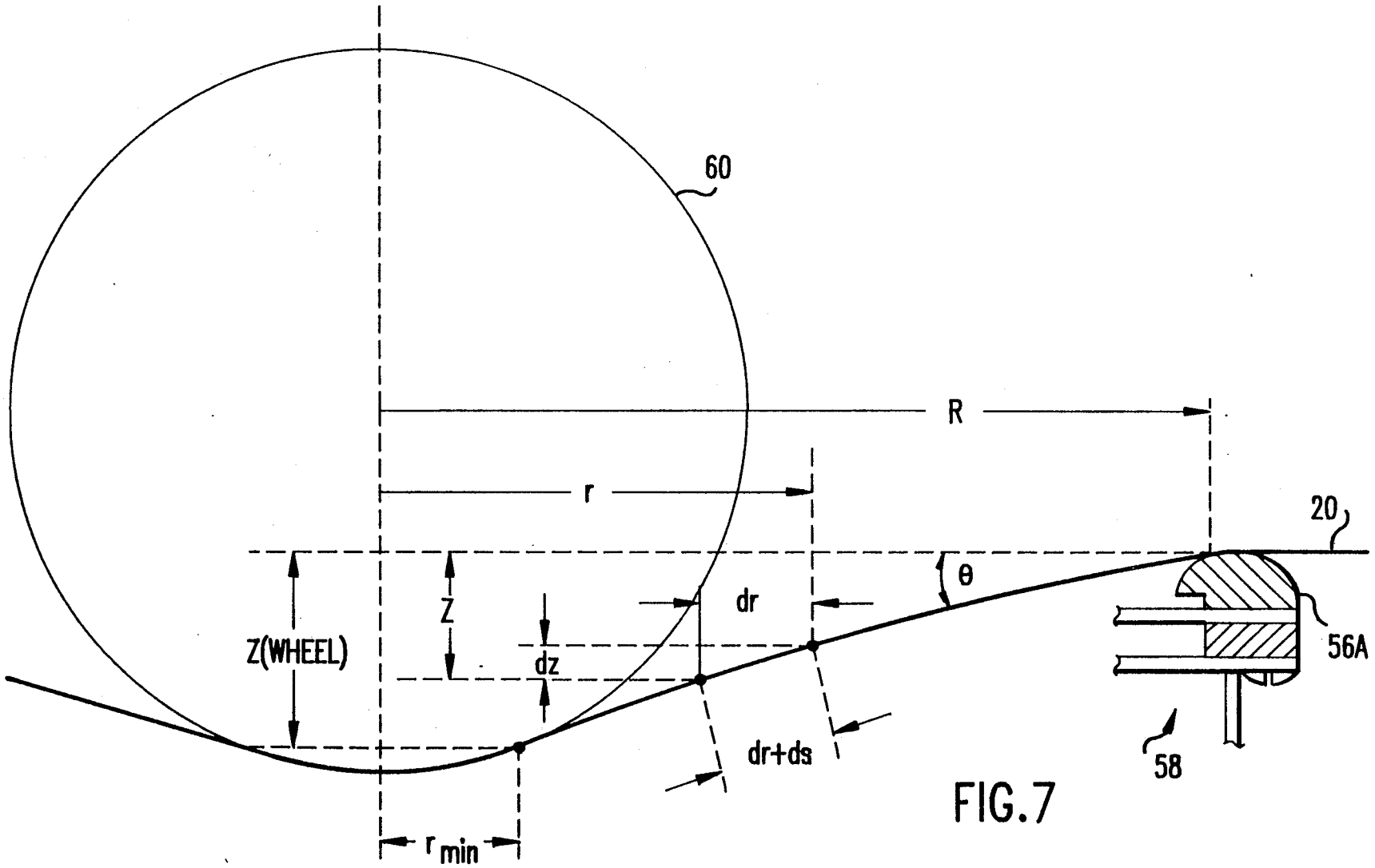
FIG. 7 is a diagramatic, exaggerated, cross-sectional representation of a portion of the paperboard sheet deflected by the bending stiffness sensor wheel into the center of the sensor ring.

The geometry of the strength sensor places boundary conditions on equation (5). Referring to Fig. 7, the wheel 60 deflects the board 20 a distance z below the plane defined by the undeflected board immediately outside of the ring 56. Also, because the contact area between the wheel 60 and board 20 is finite, the wheel 60 also defines a minimum radius wherein the deflecting force of the wheel 60 is applied to the board 20. Moreover, the ring 56 defines a discontinuity which forces the deflected board 20 back into the original plane of the undeflected board at the ring radius, R. Therefore, in mathematical terms:

$$\text{at } r = r_{min}, \text{ then } z(r) = z(\text{wheel}); \text{ and} \quad (6)$$

$$\text{at } r = R, \text{ then } z(r) = 0, \quad (7)$$

where, z(wheel) = the distance between the plane defined by the undeflected board 20 outside of the ring 56 and the edge of the wheel 60 where the board 20 diverges from the wheel 60, and $r_{min}$ = the radial distance from the center of the ring 60 to the point where the board 20 diverges from the wheel 60.

The boundary conditions above can be expressed as a boundary condition integral, as follows:

$$z(\text{wheel}) = \int_{r_{min}}^{R} (dz(r)/dr)*dr \quad (8)$$

where:

z(r) = the vertical displacement, at radial position r, of the board 20 beneath the plane of the undeflected board, dz(r)/dr = the slope of the deflected board 20 at radius r.

From the geometry illustrated in cross-section in FIG. 7, it is seen that the slope of the board 20 at any position, r, can be defined mathematically as:

$$dz(r)/dr = \sqrt{(dr + ds)^2 - dr^2}\ /dr \quad (9)$$

By substituting equation (5) into equation (9) and equation (9) into equation (8), the boundary condition integral of equation (8) yields a function, A(z), such that:

$$df(\phi)/d(\phi = A(z)*E(\phi)*t, \quad (10)$$

wherein A(z) is a function whose value may be determined numerically for any particular bending stiffness sensor having a known ring diameter and known deflection wheel circumference. The function A(z) is representative of the stress in the deflected portion of the paperboard sheet within the ring for any particular deflection, z.

As discussed above, and as apparent from the geometry of the bending stiffness sensor 34, the load cells, 62A, 62B, 62C and 62D, measure only the component of $df(\phi)/d(\phi)$ which is in the direction normal to the plane defined by the undeflected paperboard sheet 20 outside of the ring 56. From FIG. 7, it can be seen that this force component is:

$$(df(\phi)/d\phi)_{normal} = (df(\phi)/d\phi)*\sin\theta = (df(\phi)/d(\phi))*dz/(dr + ds). \quad (11)$$

Therefore, by combining equations 5, 9 and 10 into equation 11, function L(Z) is determined, as follows:

$$(df(\phi)/d\phi)\text{normal} = E(\phi)*t*L(Z). \quad (12)$$

Where $$L(z) = A(z)*\sqrt{(2*A(z)/R + (A(z)/R)^2)}\ /(1 + A(z)/R). \quad (13)$$

The function L(z) relates the force, which the board 20 applies to the sensor ring 56 in the direction normal to the plane defined by the undeflected board, to the extensional stiffness of the sheet in direction $\phi$. To determine the absolute magnitude of this contribution to the load measured by the load cells, 62A, 62B, 62C and 62D, it is necessary to evaluate the proportionality constants $A_{md}$ and $A_{cd}$. However, as will be seen below, the $A_{md}$ and $A_{cd}$ constants are not necessary to the evaluation of bending stiffness and, therefore, these proportionality constants will not be evaluated herein.

Evaluation of $B_{md}$ and $B_{cd}$

To calculate how the machine directionally oriented tension contributes to the bending stiffness of the paperboard sheet, it is assumed that the machine directionally oriented tension on the paperboard sheet 20 inside the ring 56 is the same as the tension outside the ring 56. The tension contribution to the force measured by the load cells, 62A, 62B, 62C and 62D, is then calculated by a purely geometrical analysis. When the spherical section wheel 60 pushes the paperboard sheet 20 into the center of the ring 56, the paperboard sheet 20 forms an approximately cone-shaped surface. Using cartesian coordinates with the machine directions as the X axis, the cross directions as the Y axis, and the Z axis normal to the plane of the ring 56, it is assumed that the tension is applied only in the X direction, with no Y or Z components. When the sheet 20 is deformed by the wheel 60, the machine direction tension applied by the sheet processing equipment remains unchanged, but with respect to the coordinate system, a Z component of tension is created, the X component is reduced and there remains no Y component.

The component of force measured by the machine direction load cells, 62A and 62C, on the ring segments, 56A and 56C, respectively, and caused by the machine direction tension applied to the paperboard sheet 20 by the papermaking machine is described mathematically as:

$$F_{MDT}(i) = B_{md}*T(i)*t(i)*\tan(\theta), \quad (14)$$

where:

$F_{MDT}(i)$ is the sum of the force measured by both of the machine direction load cells, 62A and 62C, and which is caused by the machine direction tension at cross directional position i of the board;

T(i) is the sheet tension at cross directional position i applied by the papermaking machine. In the case where paperboard sheet tension is measured as a function of pinch roll motor current, then T(i) is simply the average sheet tension;

t(i) is the thickness of the paperboard sheet 20 passing through the sensor 34 at cross directional position i. t(i) may be measured with a conventional sheet caliper gauge;

$\theta$ is the angle formed between the deflected sheet portion immediately adjacent the inside of the sensor ring 56, and the plane formed by the undeflected sheet 20 outside the ring 56 measured along a radius of the ring 56; and $B_{md}$, discussed below, is a proportionality constant having a value of 149.21 mm.

The mathematical model assumes that the paperboard processing machinery does not apply any tension to the board 20 in the cross-directions, as is the usual case in practice. Nevertheless, because each of the cross directional ring segments, 56B and 56D, occupies a finite 90° arc of the ring circle, the force of the board 20 against these cross directional ring segments, 56B and 56D, will be affected by the machine direction tension. Accordingly, the force of the sheet 20 against the cross directional ring segments, 56B and 56D, caused by the machine direction tension can also be calculated. The sum of the measured force component on both of the cross directional ring segments, 56B and 56D, resulting from the machine direction tension is described mathematically as:

$$F_{CDT}(i) = B_{CD}*T(i)*\tan(\theta), \quad (15)$$

where $F_{CDT}(i)$ is the sum of the force measured by both of the cross directional load cells, 62B and 62D, which is caused by the machine direction tension at cross directional position i of the sheet 20;

$B_{CD}$ is a constant having a value of 24.72 mm; and the other equation terms are the same as defined above for equation (14). The determination of the $B_{CD}$ value is also discussed below.

The Z component of tension, which all the load cells 62A–62D of the sensor ring 56 measure, depends on the distance of the cone wall along the Y axis from the center of the ring 56. At a distance y from the center of the ring 56 along the Y axis, a section through the cone in the X-Z plane is cut. This conic section forms a parabola. The Z component of the tension where the conic section meets the ring 56 produces a force measured by the load cells 62A, 62B, 62C and 62D, and which may be described mathmatically as:

$$df = T(i)*t(i)*dy*\sin\theta' \quad (16)$$

where $\theta'$ is the angle between the plane of the upper ring surface (or the sheet outside of the ring) and the parabolic section cut in the X-Z plane of the paperboard sheet 20 at a distance y from the center of the ring 56 along the Y axis at the point where the parabola touches the ring 56.

The value of sin $\theta'$ can be found from the derivative of the equation for the parabola formed by the conical section, thus:

$$z = a*x^2 + b, \quad (17)$$

the derivative of which is:

$$\frac{dz}{dx} = 2\,a*x = -\sin\theta', \quad (18)$$

where, from the boundary conditions it can be computed that, $$\text{at } z = 0,\ a = \frac{-b}{x(\text{ring})^2} = \frac{-b}{R^2 - y^2}; \quad (19)$$

and

-continued $$\text{at } x = 0.\ b = z\,(\min) = \frac{(R - y) * z\,(\text{at cone apex})}{R}; \quad (20)$$

Where

R = the radius of the sensor ring 56 measured from the center of the ring 56 to the point where the deflected sheet 20 contacts the ring 56, and z(min) is the minimum z value attained by the parabola as a function of y.

The value of sin $\theta'$ is $-dz/dx$, at x = x(ring), therefore:

$$\sin\theta' = \frac{2 * (R - y) * z(\text{at cone apex})/R}{\sqrt{R^2 - y^2}} \quad (21)$$

The element of force is thus:

$$df = T(i) * t(i) * \frac{\left(2(R - y) * \frac{z(\text{at cone apex})}{R}\right)}{\sqrt{R^2 - y^2}}\, dy \quad (22)$$

The component of the output of the machine direction load cells resulting from the machine-directionally oriented sheet tension is the force, df, integrated over the two 90° machine direction ring segments, as follows:

$$4 * \int_0^{R*\sin(\pi/4)} \frac{df}{dy}\, dy = F_{MDT}(i) = 4 * \int_0^{R*\sin(\pi/4)} (T(i)*t(i)*\sin(\theta')*dy \quad (23)$$

$$= 4*T(i)*t(i) \int_0^{R*\sin\left(\frac{\pi}{4}\right)} 2\left[\frac{(R - y)*z(\text{apex})}{R\sqrt{R^2 - y^2}}\right] dy$$

Similarly, for the cross-direction:

$$4 * \int_{R*\sin\left(\frac{\pi}{4}\right)}^{R} \frac{df}{dy}\, dy = F_{CDT}(i) = 4 * \int_{R*\sin\left(\frac{\pi}{4}\right)}^{R} T(i)*t(i)*\sin(\theta')dy \quad (24)$$

$$= 4*T(i)*t(i)*2 \int_{R*\sin\left(\frac{\pi}{4}\right)}^{R} \left[\frac{(R - y)*z(\text{apex})}{R\sqrt{R^2 - y^2}}\right] dy$$

Utilizing equations (14) and (15) above, and the fact that $$\tan\theta = \frac{z(\text{apex})}{R}$$

yields:

$$B_{md} = 8 \int_0^{R*\sin\left(\frac{\pi}{4}\right)} \frac{R - y\, dy}{\sqrt{R^2 - y^2}}, \quad (25)$$

and $$B_{cd} = 8 \int_{R*\sin\left(\frac{\pi}{4}\right)}^{R} \frac{(R - y)\, dy}{\sqrt{R^2 - y^2}} \quad (26)$$

These integrals may be evaluated numerically with the result that $B_{md}$ is equal to 149.21 mm and $B_{cd}$ is equal to 24.72 mm.

Evaluation of Bending Stiffness

Once L(Z(i)), $B_{md}$ and $B_{cd}$ have been evaluated, the bending stiffness can be determined. Bending stiffness is determined utilizing the load cell output values for each of the two wheel positions discussed previously, for example, the 1.5 mm and 3.5 mm sheet deflection positions of the wheel. For the first wheel deflection position, equation 2 may be written:

$$\frac{\text{Output}_{md1}(i)}{z_1(i)} = A_{md}*E_{md}(i)*t(i)*\frac{L(z_1(i))}{z_1(i)} + B_{md}*T(i)*\frac{t(i)}{R} + C_{md}*\frac{b_{md}(i)}{R}. \quad (27)$$

Similarly, for the second wheel position, equation 2 can be written:

$$\frac{\text{Output}_{md2}(i)}{z_2(i)} = A_{md}*E_{md}(i)*t(i)*\frac{L(z_2(i))}{z_2(i)} + B_{md}*T(i)*\frac{t(i)}{R} + C_{md}*\frac{b_{md}(i)}{R}. \quad (28)$$

Subtraction of Equation 28 from Equation 27, yields:

$$E_{md}(i)t(i) = \frac{1}{A_{md}}\left[\frac{\text{Output}_{md1}(i)}{z_1(i)} - \frac{\text{Output}_{md2}(i)}{z_2(i)}\right] \div \left[\frac{L(z_1(i))}{z_1(i)} - \frac{L(z_2(i))}{z_2(i)}\right]. \quad (29)$$

The combination of Equation 29 and 27, yields:

$$b_{md}(i)C_{md} = R * \left[\frac{L(z_1(i))}{z_1(i)} * \frac{\text{Output}_{md2}(i)}{z_2(i)} - \frac{L(z_2(i))}{z_2(i)} * \frac{\text{Output}_{md1}(i)}{z_1(i)}\right] \div \left[\frac{L(z_1(i))}{z_1(i)} - \frac{L(z_2(i))}{z_2(i)}\right] - B_{md} * T(i)\, t(i). \quad (30)$$

From equation 30 above, it can be seen that the resistance of the paperboard sheet 20 to bending in the machine direction is a function of the machine direction load cell outputs, sheet tension, sheet thickness, sheet deflection at the two wheel positions and the constants $B_{md}$ and $C_{md}$.

A similar equation can be determined for the cross-directional bending resistance utilizing the same mathematical process set forth above, such that:

$$b_{cd}(i)C_{cd} = R * \left[ \frac{L(z_1(i))}{z_1(i)} * \frac{\text{Output}_{cd2}(i)}{z_2(i)} - \frac{L(z_2(i))}{z_2(i)} * \frac{\text{Output}_{cd1}(i)}{z_1(i)} \right] \div \left[ \frac{L(z_1(i))}{z_1(i)} - \frac{L(z_2(i))}{z_2(i)} \right] - B_{cd} * T(i)\, t(i). \quad (31)$$

Finally, the values $b_{md}(i)C_{md}$ and $b_{cd}(i)C_{cd}$ may be correlated to standard laboratory bending stiffness values. For example, in the case of Taber stiffness measurements:

$$S_{md}(i) = K_{md} b_{md}(i) C_{md}; \text{ and}$$

$$S_{cd}(i) = K_{cd} b_{cd}(i) C_{cd}$$

where, $S_{md}(i)$ and $S_{cd}(i)$ are Taber stiffness values and $K_{md}$ and $K_{cd}$ are constants relating to the laboratory Taber stiffness values to the values for $b_{md}(i)C_{md}$ and $b_{cd}(i)C_{cd}$ determined on-line by the present bending stiffness sensor 34. Since $C_{md}$ and $C_{cd}$ are constants, the value of these terms need not be determined independent of the values for the products $b_{md}(i)C_{md}$ and $b_{cd}(i)C_{cd}$. The values of $K_{md}$ and $K_{cd}$ may be determined by well known curve fitting techniques correlating $S_{md}(i)$ to $b_{md}(i)C_{md}$ and $S_{cd}(i)$ to $b_{cd}(i)C_{cd}$.

As seen in the equations 2 and 3, and as previously mentioned, the load output of the four quadrants of the ring 56 is a result of the strain caused in the paperboard sheet 20 by the deflecting wheel 60, the tension in the board 20 created by the sheet processing equipment and the board bending stiffness. However, in many practical paperboard manufacturing situations, the strain term may be negligible in comparison to the bending term. In addition, in many practical paperboard manufacturing situations, the tension in the board may also be minimal at the point in the paperboard manufacturing process where the bending stiffness sensor 34 is located. Therefore, analysis of equations 2 and 3 indicate that, in this situation, the machine direction and cross direction load cell outputs are simply proportional to the machine and cross direction bending stiffnesses, respectively, and the z deflection value. Under these conditions, proportionality constants $K'_{md}$ and $K'_{cd}$, may be determined experimentally so that:

$$S_{md}(i) = K'_{md} \frac{\text{Output}_{md}(i)}{z(i)};$$

and

-continued $$S_{cd}(i) = K'_{cd} \frac{\text{Output}_{cd}(i)}{z(i)},$$

where the proportionality constants, $K'_{md}$ and $K'_{cd}$ are evaluated empirically by well known curve fitting techniques to correlate the laboratory determined values of machine direction and cross direction bending stiffness $S_{md}(i)$ and $S_{cd}(i)$, with the load cell output values, $\text{Output}_{md}(i)$ and $\text{Output}_{cd}(i)$.

In summary, the sheet bending stiffness sensor 34 can be mounted to a scanner 46 in a paperboard manufacturing machine. The output signals from the sheet deflection sensor 72 and the load cells, 62A, 62B, 62C and 62D, of the bending stiffness sensor 34 can be transmitted to a system process control computer 70, along with paperboard sheet tension signals, for determination of bending stiffness. Accordingly, the mill process control computer 70 can be programmed to periodically perform the mathematical computations described above at each cross-directional position, i, across the board 20 as the bending stiffness sensor 34 scans back and forth in the cross-direction. If the system process control computer 70 for the board manufacturing machine is programmed with a desired bending stiffness, then the computer 70 can monitor the bending stiffness values computed for the board 20 and adjust the board manufacturing parameters to insure that the bending stiffness of the manufactured board 20 meets the desired bending stiffness specification. If, for example, the computer 70 determines that the board 20 is not sufficiently rigid at one or more cross-directional positions, the computer 70 can control the flexion of the slice lips, 24, 30, for the primary and/or secondary headboxes, 14, 26, to increase the amount of paper pulp slurry 12 deposited into the first and/or second plies at such cross-directional positions. Alternatively, the computer 70 could decrease the bending stiffness by, for example, decreasing the flow of paper pulp slurry 12 from the secondary headbox 26 at each such cross-directional position. There are numerous other known processes which may likewise be adjusted under computer control to increase or decrease paperboard sheet bending stiffness.

One embodiment of the present bending stiffness sensor has been described. Certain bending stiffness computing equations have also been disclosed. Nevertheless, it is understood that one may make various modifications to the disclosed bending stiffness sensor and equations without departing from the spirit and scope of the invention. For example, the ring-shaped paperboard support may be formed into shapes other than circular and the board may be deflected using a deflecting member other than a rotating wheel. Also, the wheel need not be positioned to deflect the sheet down into the ring. Instead, the bending stiffness sensor could be disposed in other orientations such that, for example, the wheel deflects the sheet up into the ring. Thus, the invention is not limited to the embodiments described herein, but may be altered in a variety of ways apparent to person skilled in the art.

We claim:

1. A method for determining the bending stiffness of a sheet movable under tension, T, in a direction of travel, said sheet having bending resistance, b, extensional stiffness and a caliper, t, said method comprising the steps of:

supporting open side of the sheet by a generally ring-like support means having a radius, R, and defining an unsupported region along the one side of the sheet within the confines of the support means;

applying a force to the sheet to deflect the sheet into the unsupported region a first distance, $z_1$;

detecting a first quantity, $O_1$, indicative of the force exerted on the support means caused by deflecting the sheet the first distance;

applying a force to the sheet to deflect the sheet into the unsupported region a second distance, $z_2$;

detecting a second quantity, $O_2$, indicative of the force exerted on the support means caused by deflecting the sheet the second distance; determining the bending resistance of said sheet based upon the following expression:

$$(b)(C) = R\left[\left(\frac{L(z_1)}{z_1}\right)\left(\frac{O_2}{z_2}\right)-\left(\frac{L(z_2)}{z_2}\right)\left(\frac{O_1}{z_1}\right)\right] \Big/ \left[\left(\frac{L(z_1)}{z_1}\right)-\left(\frac{L(z_2)}{z_2}\right)\right] - (B)(T)(t)$$

where:

$L(z_1)$ and $L(z_2)$ = functions relating the extensional stiffness of the sheet to stress in the sheet caused by said first and second deflections, respectively; and B and C = proportionality constants; and correlating the value of bending resistance so determined to a standard value of bending stiffness.

2. A method for determining the bending stiffness of a sheet, as defined in claim 1, wherein the sheet has a machine direction in the direction of travel and a cross direction perpendicular to the direction of travel, the method further including the steps of:

detecting the first and second quantities, $O_1$ and $O_2$, in the machine direction and in the cross direction;

determining the values of the bending resistance of the sheet in the machine direction and in the cross direction; and correlating the values of bending resistance so determined to standard values of machine direction and cross direction bending stiffnesses.

3. A method for determining the bending stiffness of a sheet, as defined in claim 2, in which the sheet has a width and further including the steps of:

moving the support means along the width of the sheet; and determining the values of bending stiffness at selected positions along the width of the sheet.

* * * * *